US009957836B2

(12) United States Patent
Sun et al.

(10) Patent No.: US 9,957,836 B2
(45) Date of Patent: May 1, 2018

(54) TITANIUM ALLOY HAVING GOOD OXIDATION RESISTANCE AND HIGH STRENGTH AT ELEVATED TEMPERATURES

(71) Applicant: RTI International Metals, Inc., Niles, OH (US)

(72) Inventors: Fusheng Sun, Canfield, OH (US); Ernest M. Crist, Transfer, PA (US); Kuang-O Yu, Highland Heights, OH (US)

(73) Assignee: RTI International Metals, Inc., Niles, OH (US)

( * ) Notice: Subject to any disclaimer, the term of this patent is extended or adjusted under 35 U.S.C. 154(b) by 769 days.

(21) Appl. No.: 13/840,265

(22) Filed: Mar. 15, 2013

(65) Prior Publication Data

US 2015/0192031 A1 Jul. 9, 2015

Related U.S. Application Data

(60) Provisional application No. 61/673,313, filed on Jul. 19, 2012.

(51) Int. Cl.

| | |
|---|---|
| ***C22C 1/02*** | (2006.01) |
| ***F01D 25/00*** | (2006.01) |
| ***C22C 14/00*** | (2006.01) |
| ***C22F 1/18*** | (2006.01) |
| ***F01D 5/28*** | (2006.01) |

(52) U.S. Cl.

CPC ..... *F01D 25/005* (2013.01); *C22C 1/02* (2013.01); *C22C 14/00* (2013.01); *C22F 1/183* (2013.01); *F01D 5/28* (2013.01)

(58) Field of Classification Search

CPC ..... C22C 14/00

See application file for complete search history.

(56) References Cited

U.S. PATENT DOCUMENTS

| | | | | |
|---|---|---|---|---|
| 2,893,864 | A * | 7/1959 | Harris | C22C 14/00 420/418 |
| 3,619,184 | A * | 11/1971 | Bomberger, Jr. | C22C 14/00 420/419 |
| 4,087,292 | A | 5/1978 | Neal et al. | |
| 4,229,216 | A | 10/1980 | Paton et al. | |
| 4,292,077 | A | 9/1981 | Blackburn et al. | |
| 4,595,413 | A | 6/1986 | Hard et al. | |
| 4,639,281 | A | 1/1987 | Sastry et al. | |
| 4,716,020 | A | 12/1987 | Blackburn et al. | |
| 4,738,822 | A | 4/1988 | Bania | |

(Continued)

FOREIGN PATENT DOCUMENTS

| | | |
|---|---|---|
| CN | 101514412 | 2/2008 |
| CN | 101768685 | 7/2010 |

(Continued)

*Primary Examiner* — Christopher Kessler

(74) *Attorney, Agent, or Firm* — Greenburg Traurig, LLP

(57) ABSTRACT

A titanium alloy may be characterized by a good oxidation resistance, high strength and creep resistance at elevated temperatures up to 750° C., and good cold/hot forming ability, good superplastic forming performance, and good weldability. The alloy may contain, in weight percent, aluminum 4.5 to 7.5, tin 2.0 to 8.0, niobium 1.5 to 6.5, molybdenum 0.1 to 2.5, silicon 0.1 to 0.6, oxygen up to 0.20, carbon up to 0.10, and balance titanium with incidental impurities.

23 Claims, 7 Drawing Sheets

(56) References Cited

U.S. PATENT DOCUMENTS

| | | | |
|---|---|---|---|
| 4,770,726 | A | 9/1988 | Neal et al. |
| 4,810,465 | A | 3/1989 | Kimura et al. |
| 4,836,983 | A | 6/1989 | Huang et al. |
| 4,906,436 | A | 3/1990 | Gigliotti et al. |
| 4,915,905 | A | 4/1990 | Kampe et al. |
| 4,980,127 | A | 12/1990 | Parris et al. |
| 5,019,334 | A | 5/1991 | Jackson |
| 5,032,357 | A | 7/1991 | Rowe |
| 5,041,262 | A | 8/1991 | Gigliotti |
| 5,045,406 | A | 9/1991 | Huang |
| 5,080,860 | A | 1/1992 | Huang |
| 5,082,506 | A | 1/1992 | Huang |
| 5,082,624 | A | 1/1992 | Huang |
| 5,089,225 | A | 2/1992 | Huang |
| 5,171,408 | A | 12/1992 | Thornton |
| 5,205,875 | A | 4/1993 | Huang |
| 5,213,635 | A | 5/1993 | Huang |
| 5,264,051 | A | 11/1993 | Huang |
| 5,431,874 | A | 7/1995 | Gigliotti, Jr. |
| 5,922,274 | A | 7/1999 | Suzuki et al. |
| 5,997,808 | A | 12/1999 | Jones et al. |
| 6,004,368 | A | 12/1999 | Chandley et al. |
| 6,007,923 | A | 12/1999 | Shimizu et al. |
| 6,284,071 | B1 | 9/2001 | Suzuki et al. |
| 6,401,537 | B1 | 6/2002 | Gigliotti, Jr. et al. |
| 6,596,412 | B2 | 7/2003 | Mergen |
| 6,692,586 | B2 | 2/2004 | Xu et al. |
| 6,767,418 | B1 | 7/2004 | Zhang et al. |
| 6,767,653 | B2 | 7/2004 | Bewlay et al. |
| 6,786,985 | B2 | 9/2004 | Kosaka et al. |
| 6,997,995 | B2 | 2/2006 | Janschek et al. |
| 7,479,194 | B2 | 1/2009 | DeLuca |
| 7,704,339 | B2 | 4/2010 | Voice et al. |
| 7,767,040 | B2 | 8/2010 | Kosaka et al. |
| 2003/0084970 | A1 | 5/2003 | Ariyasu et al. |
| 2003/0094222 | A1 | 5/2003 | Lin et al. |
| 2005/0234561 | A1 | 10/2005 | Nutt et al. |
| 2005/0260433 | A1 | 11/2005 | Sakashita et al. |
| 2007/0031730 | A1 | 2/2007 | Kawakami et al. |
| 2007/0137742 | A1 | 6/2007 | Hao et al. |
| 2008/0069720 | A1 | 3/2008 | Renkel et al. |
| 2008/0152533 | A1 | 6/2008 | Ernst et al. |
| 2009/0004042 | A1 | 1/2009 | Matsumoto et al. |
| 2009/0180918 | A1 | 7/2009 | Tsai et al. |
| 2009/0181794 | A1 | 7/2009 | Tsai et al. |
| 2009/0202385 | A1 | 8/2009 | Armstrong et al. |
| 2010/0173171 | A1 | 7/2010 | Yashiki et al. |
| 2010/0310410 | A1 | 12/2010 | Matsuoto et al. |
| 2010/0320317 | A1 | 12/2010 | Fanning |
| 2011/0027121 | A1 | 2/2011 | Kosaka et al. |
| 2011/0091350 | A1 | 4/2011 | Haidar |
| 2011/0262667 | A1 | 10/2011 | Welsch et al. |
| 2011/0268602 | A1 | 11/2011 | Wright et al. |
| 2012/0076611 | A1 | 3/2012 | Bryan |
| 2012/0076686 | A1 | 3/2012 | Bryan et al. |

FOREIGN PATENT DOCUMENTS

| | | |
|---|---|---|
| CN | 101886189 | 11/2010 |
| JP | H04202729 | 7/1992 |
| JP | H08120373 | 5/1996 |
| JP | H0931572 | 2/1997 |
| RU | 1619729 | 8/1995 |
| RU | 2437948 | 12/2011 |

* cited by examiner

Ti-6Al-4Sn-3Nb-0.5Mo-0.3Si

Ti-6Al-2Sn-4Zr-2Mo-0.1Si

Ti-15Mo-3Nb-3Al-0.3Si

Ti-6Al-4Sn-3Nb-0.5Mo-0.3Si

Ti-6Al-2Sn-4Zr-2Mo-0.1Si

Ti-15Mo-3Nb-3Al-0.3Si

Ti-6Al-6Sn-6Nb-0.5Mo-0.3Si

Ti-6Al-2Sn-4Zr-2Mo-0.1Si

Ti-15Mo-3Nb-3Al-0.3Si

Ti-6Al-2Sn-4Zr-2Mo-0.1Si

Ti-6Al-6Zr-6Nb-0.5Mo-0.3Si

Ti-6Al-2Sn-4Zr-6Nb-0.5Mo-0.3Si

Ti-6Al-6Sn-6Nb-0.5Mo-0.3Si

Ti-6Al-6Sn-3Nb-0.5Mo-0.3Si

TITANIUM ALLOY HAVING GOOD OXIDATION RESISTANCE AND HIGH STRENGTH AT ELEVATED TEMPERATURES

CROSS REFERENCE TO RELATED APPLICATION

This application claims priority from U.S. Provisional Application Ser. No. 61/673,313, filed Jul. 19, 2012; the disclosure of which is incorporated herein by reference.

BACKGROUND OF THE INVENTION

While titanium alloys have been used extensively in aerospace and other applications, the need for relatively lightweight alloys for use at elevated temperatures has increased. For example, the higher performance and higher fuel efficiency of airplanes and aero-engines are leading to the development of aero-engines and airframes operating at increased temperatures and decreased weight. As a result, titanium alloys are being considered for use in the hotter section of engine nacelles or in airframe parts which undergo higher operating temperatures, such as aft pylon components. These developments have led to a need to replace heavy nickel base alloys (and others) with titanium alloys having excellent oxidation resistance and high strength at elevated temperatures, such as, for instance, 650° C., 700° C. or 750° C. or higher.

While titanium alloys such as Ti-6Al-2Sn-4Zr-2Mo-0.1Si and Ti-15Mo-3Al-3Nb-0.2Si have been used to form the airframe or aero-engine components for which oxidation resistance, heat resistance and lightness are required, the oxidation resistant temperature of these alloys is usually limited below 650° C. Thermal exposure at 700-750° C. for prolonged periods leads to severe flaking of components formed of these two alloys. Moreover, the latter alloy has significantly lower strength when service temperatures reach 700-750° C., as it is a near-beta titanium alloy.

Several titanium alloys are noted below which provide varying desirable characteristics, but which are not suitable for the above-noted purpose. The commercial titanium alloys Ti-6Al-2Sn-4Zr-2Mo-0.1Si and Ti-15Mo-3Nb-3Al-0.3Si disclosed in U.S. Pat. No. 4,980,127 are near-beta titanium alloys with very high content of molybdenum. U.S. Pat. No. 4,738,822 discloses a niobium-free near-alpha titanium alloy, Ti-6Al-2.7Sn-4Zr-0.4Mo-0.4Si, which has good strength and creep resistance at fairly elevated temperatures. U.S. Pat. No. 4,906,436 and U.S. Pat. No. 5,431,874 disclose high temperature titanium alloys containing hafnium and tantalum.

U.S. Pat. No. 4,087,292 and U.S. Pat. No. 4,770,726 respectively disclose two niobium-containing titanium alloys, Ti-5.5Al-3.5Sn-3Zr-1Nb-0.25Mo-0.3Si (known as IMI 829) and Ti-5.8Al-4Sn-3.5Zr-0.7Nb-0.5Mo-0.35Si-0.06C (known as IMI 834), which show good creep resistance at elevated temperatures. U.S. Pat. No. 6,284,071 discloses a high temperature titanium alloy which normally contains 3.5% zirconium and optionally up to 2.0% niobium. The titanium alloys of the three previous patents contain respectively no more than 1.25, 1.5 and 2.0% niobium and respectively at least 2.0, 3.25 and 2.5% zirconium.

It will be appreciated that producing titanium alloys with excellent oxidation resistance at such high service temperatures (especially at about 700, 750° C. or higher) is extremely difficult. Thus, for example, it is a major leap forward to advance from a titanium alloy capable of operating at 650° C. to a titanium alloy capable of operating at 750° C. with good oxidation resistance and high strength.

The present titanium alloys are useful for this and other purposes, and may provide various desirable physical characteristics other than those discussed above.

SUMMARY

In one aspect, the invention may provide a high temperature titanium alloy consisting essentially of: 4.5 to 7.5% aluminum by weight; 2.0 to 8.0% tin by weight; 1.5 to 6.5% niobium by weight; 0.1 to 2.5% molybdenum by weight; 0.1 to 0.6% silicon by weight; and a balance titanium.

In another aspect, the invention may provide a high temperature titanium alloy comprising: 4.5 to 7.5% aluminum by weight; 2.0 to 8.0% tin by weight; 1.5 to 6.5% niobium by weight; 0.1 to 2.5% molybdenum by weight; 0.1 to 0.6% silicon by weight; a total of zirconium and vanadium in a range of 0.0 to 0.5% by weight; and a balance titanium.

In another aspect, the invention may provide a method comprising the steps of: providing a component formed of a titanium alloy consisting essentially of, by weight, 4.5 to 7.5% aluminum; 2.0 to 8.0% tin; 1.5 to 6.5% niobium; 0.1 to 2.5% molybdenum; 0.1 to 0.6% silicon; and a balance titanium; and operating a machine comprising the component so that the component is continuously maintained at a temperature of at least 600° C. for a duration of at least ½ hour.

DETAILED DESCRIPTION OF THE INVENTION

Generally, sample alloys of the present invention may comprise or consist essentially of about 4.5 to 7.5 weight percent aluminum (Al), about 2.0 to 8.0 weight percent tin (Sn), about 1.5 to 6.5 weight percent niobium (Nb), about 0.1 to 2.5 weight percent molybdenum (Mo), about 0.1 to 0.6 weight percent silicon (Si), and a balance titanium with incidental impurities. The percentages of various other elements which may be included in the present alloys are discussed in greater detail below. It has been found that the above-noted additions of aluminum, tin, niobium, molybdenum, and silicon to hexagonal structured titanium results in both greatly improved oxidation resistance and significantly increased strength at elevated temperatures up to 750° C. or more.

Figure 1A:
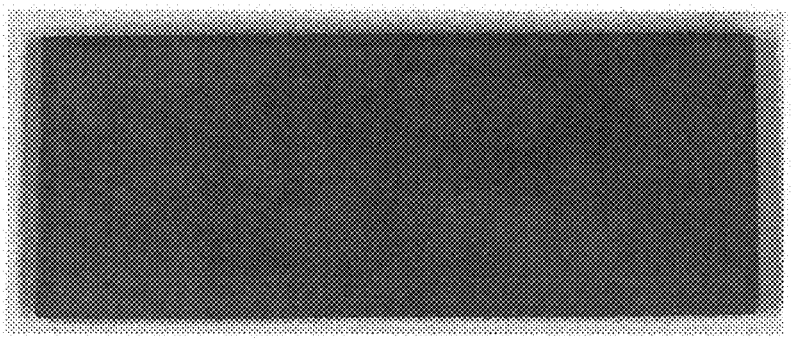
FIG. 1 represents images, without magnification, of oxidation samples after oxidation testing in air at 750° C. for 208 hours of (a) present sample titanium alloy Ti-6Al-4Sn-3Nb-0.5Mo-0.3Si, (b) prior art titanium alloy Ti-6Al-2Sn-4Zr-2Mo-0.1Si, and (c) prior art titanium alloy Ti-15Mo-3Nb-3Al-0.3Si.
Figure 1B:
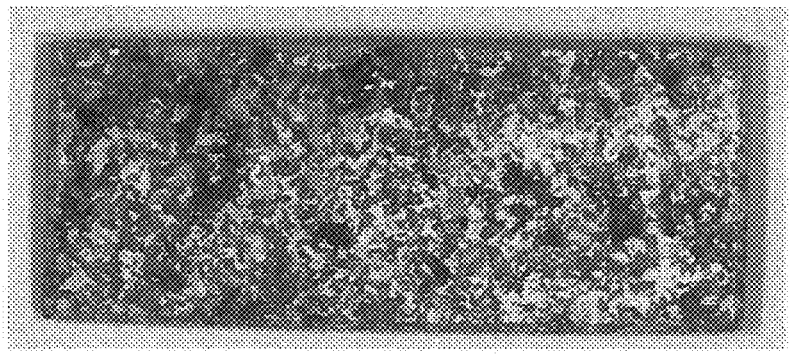
FIG-1b PRIOR ART
Figure 1C:
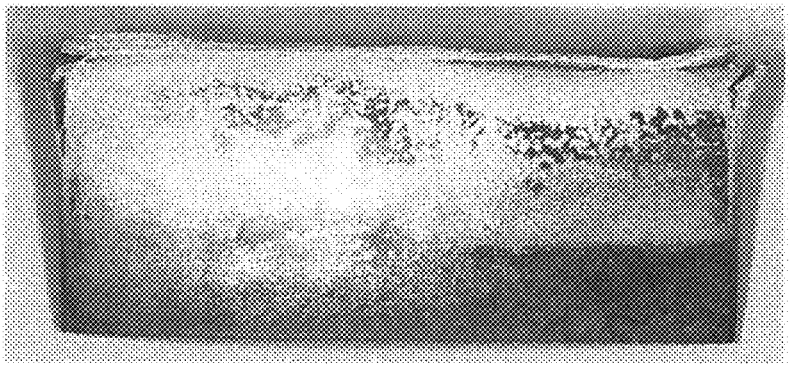
FIG-1c PRIOR ART
Figure 2A:
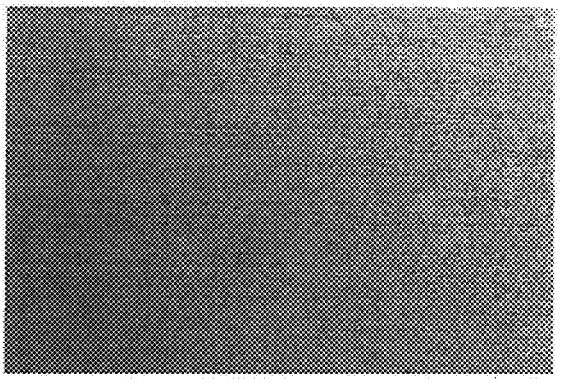
FIG. 2 represents scanning electron microscope (SEM) images, magnified 100 times, of the surface of oxidation samples after oxidation testing in air at 750° C. for 208 hours of (a) sample present titanium alloy Ti-6Al-4Sn-3Nb-0.5Mo-0.3Si, (b) prior art titanium alloy Ti-6Al-2Sn-4Zr-2Mo-0.1Si (showing severe flaking), and (c) prior art titanium alloy Ti-15Mo-3Nb-3Al-0.3Si (showing partial flaking).
Figure 2B:
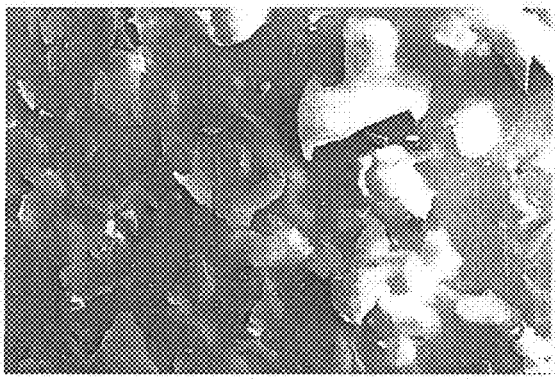
FIG-2b PRIOR ART
Figure 2C:
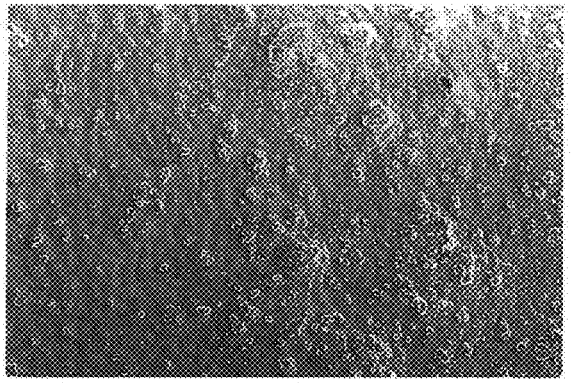
FIG-2c PRIOR ART
Figure 3A:
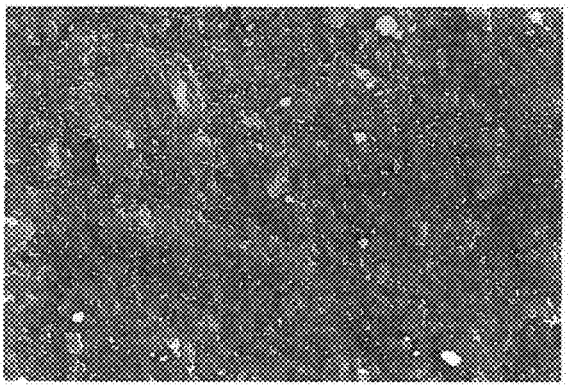
FIG. 3 represents SEM images, magnified 10,000 times, showing the oxidation layer of oxidation samples after oxidation testing in air at 750° C. for 208 hours of (a) sample present titanium alloy Ti-6Al-6Sn-6Nb-0.5Mo-0.3Si (showing very dense, thin, continuous, polygonal-shaped oxidation scale), (b) prior art titanium alloy Ti-6Al-2Sn-4Zr-2Mo-0.1Si (showing very porous, thick, loose, flaking, and rod-like-shaped oxidation scale), and (c) prior art titanium alloy Ti-15Mo-3Nb-3Al-0.3Si (showing very porous, thick, loose, and fiber-like-shaped oxidation scale).
Figure 3B:
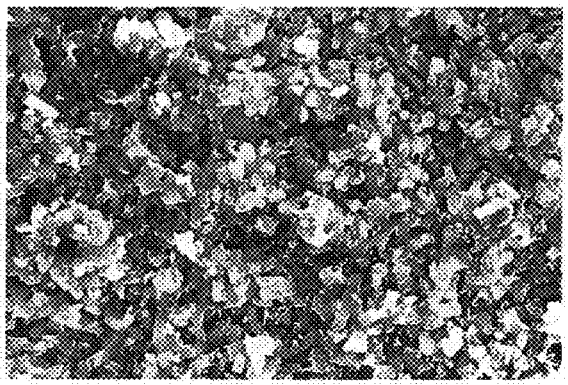
FIG-3b PRIOR ART
Figure 3C:
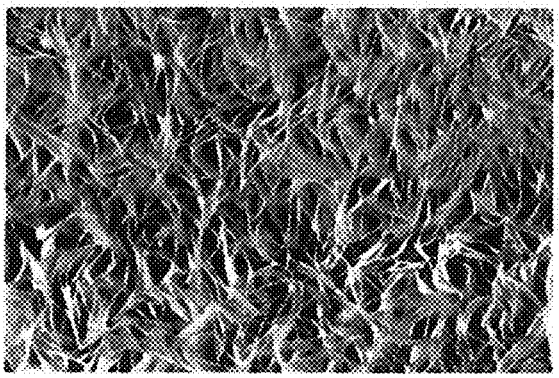
FIG-3c PRIOR ART
Figure 4A:
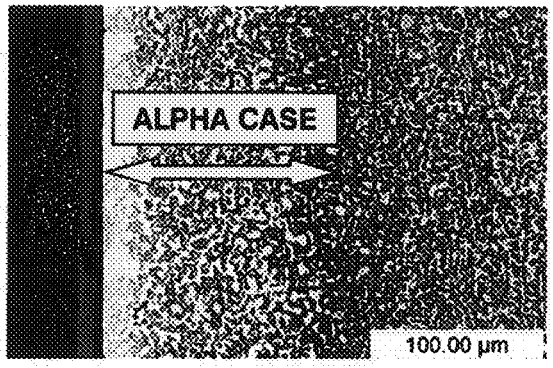
FIG-4a PRIOR ART
FIG. 4 represents micrographs showing the alpha case depth of prior art titanium alloy Ti-6Al-2Sn-4Zr-2Mo-0.1Si, (b) prior art titanium alloy Ti-6Al-6Zr-6Nb-0.5Mo-0.3Si, (c) prior art titanium alloy Ti-6Al-2Sn-4Zr-6Nb-0.5Mo-0.3Si, (d) present sample titanium alloy Ti-6Al-6Sn-6Nb-0.5Mo-0.3Si and (e) present sample titanium alloy Ti-6Al-6Sn-4Nb-0.5Mo-0.3Si.
Figure 4B:
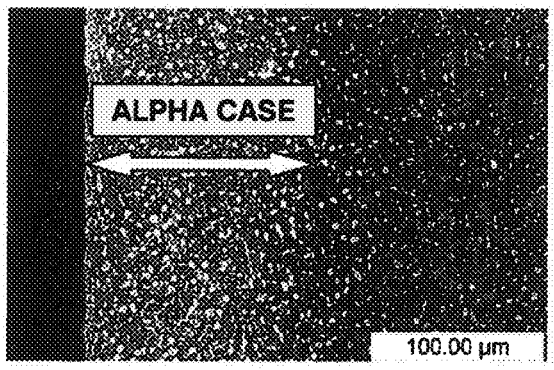
FIG-4b PRIOR ART
Figure 4C:
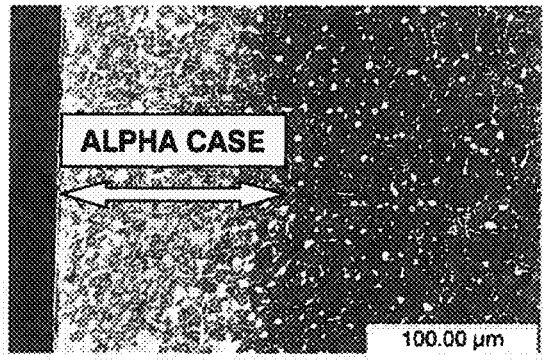
FIG-4c PRIOR ART
Figure 4D:
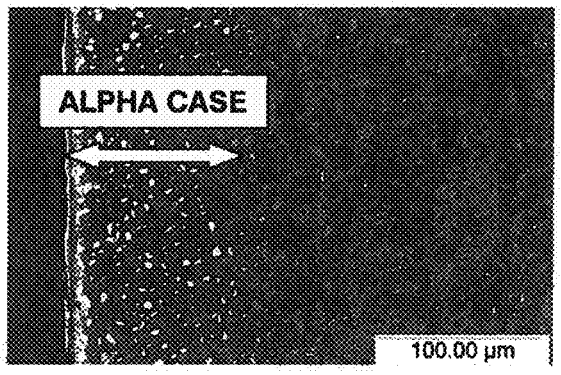
Figure 4E:
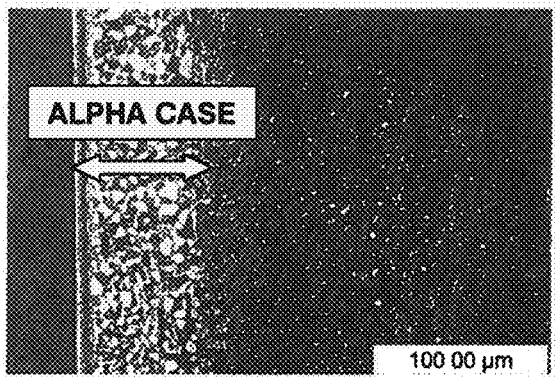

The significantly improved oxidation resistance of the titanium alloy is achieved primarily by the combined additions of niobium and tin. This is attributed to the fact that the use of niobium and tin in the alloy can form very dense, thin, continuous, polygonal-shaped oxidation scale, as shown in FIG. 3*a* at a magnification of 10,000 times. The protective oxidation scale provides a barrier that decreases the oxygen diffusion into the titanium matrix, and minimizes the thermal stress between oxidation scale and titanium to eliminate oxidation scale flaking. In contrast, a porous, thick, loose, flaking, and irregular-shaped (rods or fiber-like) oxidation scale was observed for Ti-6Al-2Sn-4Zr-2Mo-0.1Si, as shown in FIGS. 3*b*, and Ti-15Mo-3Nb-3Al-0.3Si, as shown in FIG. 3*c*, both respectively at a magnification of 10,000 times.

The oxidation resistance of a titanium alloy can be represented by alpha case depth, weight gain and scale flaking. Alpha case, which is the oxygen-rich layer beneath the oxidation scale, is a very brittle layer that can markedly deteriorate mechanical properties of titanium alloys such as ductility and fatigue strength. Resistance to the formation of alpha case is thus indicative of better oxidation resistance of a titanium alloy. Therefore, a relatively small alpha case depth (or the depth of the alpha case) indicates a relatively good oxidation resistance of a titanium alloy.

As shown in Table 4 and FIG. 4, of various titanium alloys tested, sample alloys of the invention—for example, Ti-6Al-6Sn-6Nb-0.5Mo-0.3Si (FIGS. 4*d*) and Ti-6Al-6Sn-3Nb-0.5Mo-0.3Si (FIG. 4*e*)—show not only the lowest weight gain, but also the smallest alpha case depth. The alpha case depth of the sample alloys of the invention is only about 50% of that of Ti-6Al-2Sn-4Zr-2Mo-0.1Si (FIG. 4*a*) at the same experimental conditions. Although zirconium-containing titanium alloys—for example, Ti-6Al-6Zr-6Nb-0.5Mo-0.3Si shown in FIGS. 4*b* and Ti-6Al-2Sn-4Zr-6Nb-0.5Mo-0.3Si shown in FIG. 4*c*—result in a slight increase in weight gain compared to the sample alloys of the invention—for example, Ti-6Al-6Sn-6Nb-0.5Mo-0.3Si (FIGS. 4*d*) and Ti-6Al-6Sn-3Nb-0.5Mo-0.3Si (FIG. 4*e*), the former alloys (containing Zr and Nb) show twice the alpha case depth of that of the present sample alloys (containing Sn and Nb). Investigation has confirmed that severe flaking was observed in the zirconium-containing titanium alloys.

It was discovered that zirconium has a significantly negative effect on the oxidation resistance of titanium alloys. Therefore, the excellent oxidation resistance of the present alloy is achieved in part by providing a titanium alloy composition that is substantially zirconium-free or contains a minimal amount of zirconium, as detailed further below, Thus, zirconium is typically not deliberately added as part of the alloy composition whereby any zirconium present in the alloy is usually as an impurity.

The alloys of the invention are different from known current commercial high temperature titanium alloys, such as those discussed in the Background of the present application. With respect to the oxidation resistance, elevated temperature strength and creep resistance, the alloy of the present invention is much superior to that of commercial Ti-6Al-2Sn-4Zr-2Mo-0.1Si and Ti-15Mo-3Nb-3Al-0.3Si. The latter alloy is a near-beta titanium alloy with very high content of molybdenum and thus quite different from the present alloy, which is a near-alpha titanium alloy with the combined additions of Nb and Sn.

Although Ti-6Al-2.7Sn-4Zr-0.4Mo-0.4Si is a near-alpha titanium alloy with a good combination of elevated temperature strength and creep resistance, this alloy is free of niobium and has an oxidation resistance inferior to that of the present alloys. The present alloys are also different from the alloys of U.S. Pat. No. 4,906,436 and U.S. Pat. No. 5,431,874, each of which discloses high temperature titanium alloys containing hafnium and tantalum.

The present alloys are also different from the following niobium-containing high-temperature titanium alloys. As noted in the Background of the present application, U.S. Pat. No. 4,087,292, U.S. Pat. No. 4,770,726 and U.S. Pat. No. 6,284,071 each disclose titanium alloys which contain zirconium and relatively low levels of niobium. As noted above, it has been discovered that zirconium significantly deteriorates the oxidation resistance of titanium at elevated temperatures. Furthermore, the combined additions of low niobium and high zirconium contents cause very deep alpha case and severe flaking at elevated temperatures.

Therefore, the alloy of the present invention is designed as a zirconium-free or essentially zirconium-free titanium alloy with the combined additions of tin and higher niobium (preferably 3.0-6.0%). In addition, the present alloy shows better oxidation resistance than that of the alloys of the above three patents.

The alloy of the present invention is designed as a near alpha titanium alloy. Its majority matrix phase is the close packed hexagonal alpha phase of titanium. It is strengthened by the elements aluminum, tin, niobium, molybdenum and silicon, and its oxidation resistance is improved by the combined additions of niobium and tin.

The aluminum content should generally be as high as possible to obtain maximum strengthening of alpha phase, and to avoid formation of intermetallic compound ($Ti_3Al$). The addition of aluminum is effective in improving elevated temperature strength and creep resistance. To realize this effect, addition of aluminum at least 4.5% is necessary, while too high aluminum results in the formation of brittle $Ti_3Al$ phase; therefore, aluminum content should be limited up to 7.5%.

Tin is a very effective element in improving the oxidation resistance with the combined addition of niobium. Generally speaking, the higher the tin content, the better the oxidation resistance. Tin also strengthens both alpha-phase and beta-phase, and is effective in improving elevated temperature strength. The addition of 2.0% tin or more is preferred to improve oxidation resistance and strength. However, excessive tin content can result in the formation of brittle $Ti_3Al$ phase, and deteriorates ductility and weldability. The maximum tin content should thus be controlled at no more than 8.0%.

Niobium is a very important element in significantly improving the oxidation resistance with the combined addition of tin. The combined addition of niobium and tin can result in very dense, thin, continuous, and polygonal-shaped oxidation scale when the alloy is heated to elevated temperatures. The addition of niobium can also minimize the thermal stress between oxidation scale and titanium matrix, thereby eliminating oxidation scale flaking after thermal exposure at elevated temperatures for prolonged periods. Addition of 1.5% or more niobium is preferred to improve the oxidation resistance; however, niobium is a weak beta phase stabilizer, and strengthens mainly beta phase. Addition of niobium in a large amount will introduce more beta phase, and thus decreases elevated temperature strength and creep resistance. Thus, the upper limit of niobium should be 6.5% whereby the present alloy includes 1.5 to 6.5% niobium and may, for example, include 2.0, 2.5 or 3.0% to 4.5, 5.0, 5.5, 6.0 or 6.5% niobium. In one sample embodiment, the alloy may include 2.5 to 3.5% or 2.75 to 3.25% niobium.

Tantalum may also be added to the alloy for improving oxidation resistance and elevated temperature strength. The upper limit of tantalum should be 1.0% and thus is within the range of 0.0 to 1.0% by weight.

Molybdenum is a stronger beta stabilizer and mainly strengthens beta-phase. A small amount of molybdenum (0.5%) will increase the tensile strength of the present alloy. A larger amount of molybdenum will decrease the creep resistance. Therefore, the addition of molybdenum should be in the range of from 0.1 to 2.5%.

Silicon usually forms fine titanium silicides at grain boundaries and matrix. Silicon may be added in the present alloy for improving the creep resistance. The addition of silicon from 0.1 up to 0.6% is the range at which the effect of silicon on creep resistance is appreciable.

The oxygen content in the present titanium alloy is preferably controlled, as it is a strong alpha stabilizer. Excessive oxygen content tends to decrease post-thermal exposure ductility and fracture toughness. The upper limit of oxygen is to be 0.20%, preferably 0.12%. Oxygen is typically in the range of 0.08 to 0.20% by weight or 0.08 to 0.12% by weight. Carbon in the present alloy is also typically controlled to no more than 0.10% and is usually in a range of 0.02 to 0.10% by weight or 0.02 to 0.04% by weight.

Two elements that are preferably excluded from or very limited in the present alloy are zirconium and vanadium, as they deteriorate oxidation resistance. Their combined upper limit should be controlled to no more than 0.5 weight percent. Thus, the amount of each of zirconium and vanadium is preferably in the range of 0.0 to 0.5% by weight, but also the total of zirconium and vanadium is preferably in the range of 0.0 to 0.5% by weight.

For elevated temperature strength and creep resistance improvement, the elements nickel, iron, chromium, copper and manganese should be excluded from or very limited in the present titanium alloy; each of these elements should be controlled to no more than 0.10 weight percent, and the total combined residual element content should be controlled to no more than 0.30 weight percent. Thus, each of these five elements may be in the present alloy in the range of 0.0 to 0.10% by weight and preferably the total of these five elements is in the range of 0.0 to 0.30% by weight.

The elements hafnium and rhenium are also excluded from or very limited in the present titanium alloy. Their combined upper limit should be controlled to no more than 0.3 weight percent. Thus, the amount of each of hafnium and rhenium in the present alloy is preferably in the range of 0.0 to 0.3% by weight, but also the total of hafnium and rhenium is in the range of 0.0 to 0.3% by weight.

The present titanium alloy typically contains no other elements than those discussed herein except to the degree that they do not affect or only minimally affect the goals of providing a titanium alloy which has the oxidation resistance, strength and creep resistance at the elevated temperatures discussed in greater detail herein.

The experimental alloys were first melted as 250-gm buttons, and hot rolled down to 0.100" thick sheets and heat treated. The effects of Al, Sn, Zr, Nb, Mo and Si on the oxidation resistance and mechanical properties of titanium alloys have been studied. Based on the experimental results, two alloys with nominal compositions of Ti-6Al-4Sn-3Nb-0.5Mo-0.3Si and Ti-6Al-6Sn-3Nb-0.5Mo-0.3Si were selected for scale-up study. Four 70-kg ingots were melted using the plasma arc melting technique, then hot rolled down to plates at beta phase field, and then hot rolled down to 0.135×31.5×100 inch sheets at alpha+beta phase field. The sheets were heat treated at different temperatures to produce three types of microstructures: bimodal I (15% primary alpha), bimodal II (35% primary alpha), and equiaxed microstructure (60% primary alpha). The sheets were subjected to evaluations of oxidation resistance, tensile property, creep rupture resistance, post-thermal-exposure tensile property, cold/hot forming, superplastic forming testing and weldability.

Tables 1 and 5 provide the weight gain in $mg/cm^2$ for various samples of titanium alloys which occurred when the sample was exposed to air continuously at a substantially constant given temperature over a given time period or duration. Tables 1 and 5 thus provide one measurement indicative of oxidation resistance of the various titanium alloys. Table 1 provides a comparison of such weight gain between samples of the present alloy and other titanium alloys, when the given temperature was respectively 650, 700 and 750° C. (1202, 1292 and 1382° F., respectively) for respective durations of 24, 48, 72, 96, 160 and 208 hours. In particular, the other titanium alloys in Table 1 are commercial alloys Ti-6Al-2Sn-4Zr-2Mo-0.1Si and Ti-15Mo-3Nb-3Al-0.3Si, while the present titanium alloys in Table 1 are Ti-6Al-4Sn-3Nb-0.5Mo-0.3Si and Ti-6Al-6Sn-3Nb-0.5Mo-0.3Si.

Table 5 more particularly shows the weight gain of the three above-noted types of microstructures of Ti-6Al-4Sn-3Nb-0.5Mo-0.3Si alloy at the same respective temperatures and durations. The sample present alloys exhibited much greater oxidation resistance than that of the commercial alloys Ti-6Al-2Sn-4Zr-2Mo-0.1Si and Ti-15Mo-3Nb-3Al-0.3Si, as shown in Table 1. The three types of microstructure of the present sample alloy showed only relatively slight weight gains compared to the other alloys at the same conditions. This may provide a choice of different microstructures for a good combination of excellent oxidation resistance and different mechanical property levels. Aside from the specific microstructure, the sample present alloys exhibited much better oxidation resistance than the noted commercial sample alloys.

In the tested embodiments of the present titanium alloy, the weight gain in $mg/cm^2$ was, for example, no more than 0.08, 0.09, 0.10, 0.11, 0.12, 0.13, 0.14 or 0.15 after maintaining the alloy in air continuously at a temperature of about 650° C. for 24 hours; no more than 0.11, 0.12, 0.13, 0.14, 0.15, 0.16, 0.17, 0.18, 0.19 or 0.20 after maintaining the alloy in air continuously at a temperature of about 650° C. for 48 hours; no more than 0.13, 0.14, 0.15, 0.16, 0.17, 0.18, 0.19, 0.20, 0.21 or 0.22 after maintaining the alloy in air continuously at a temperature of about 650° C. for 72 hours; no more than 0.14, 0.15, 0.16, 0.17, 0.18, 0.19, 0.20, 0.21, 0.22, 0.23, 0.24 or 0.25 after maintaining the alloy in air continuously at a temperature of about 650° C. for 96 hours; no more than 0.18, 0.19, 0.20, 0.21, 0.22, 0.23, 0.24, 0.25, 0.26, 0.27, 0.28, 0.29 or 0.30 after maintaining the alloy in air continuously at a temperature of about 650° C. for 160 hours; no more than 0.20, 0.21, 0.22, 0.23, 0.24, 0.25, 0.26, 0.27, 0.28, 0.29, 0.30, 0.31, 0.32, 0.33, 0.34 or 0.35 after maintaining the alloy in air continuously at a temperature of about 650° C. for 208 hours; no more than 0.17, 0.18, 0.19, 0.20, 0.21, 0.22, 0.23, 0.24, 0.25, 0.26 or 0.27 after maintaining the alloy in air continuously at a temperature of about 700° C. for 24 hours; no more than 0.23, 0.24, 0.25, 0.26, 0.27, 0.28, 0.29, 0.30, 0.31, 0.32, 0.33, 0.34 or 0.35 after maintaining the alloy in air continuously at a temperature of about 700° C. for 48 hours; no more than 0.28, 0.29, 0.30, 0.31, 0.32, 0.33, 0.34, 0.35, 0.36, 0.37, 0.38, 0.39, 0.40, 0.41, 0.42, 0.43, 0.44 or 0.45 after maintaining the alloy in air continuously at a temperature of about 700° C. for 72 hours; no more than 0.32, 0.33, 0.34, 0.35, 0.36, 0.37, 0.38, 0.39, 0.40, 0.41, 0.42, 0.43, 0.44, 0.45, 0.46, 0.47, 0.48, 0.49 or 0.50 after maintaining the alloy in air continuously at a temperature of about 700° C. for 96 hours; no more than 0.42, 0.43, 0.44, 0.45, 0.46, 0.47, 0.48, 0.49, 0.50, 0.51, 0.52, 0.53, 0.54, 0.55, 0.56, 0.57, 0.58, 0.59 or 0.60 after maintaining the alloy in air continuously at a temperature of about 700° C. for 160 hours; no more than 0.47, 0.48, 0.49, 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79 or 0.80 after maintaining the alloy in air continuously at a temperature of about 700° C. for 208 hours; no more than 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59 or 0.60 after maintaining the alloy in air continuously at a temperature of about 750° C. for 24 hours; no more than 0.49, 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69 or 0.70, 0.71, 0.72, 0.73, 0.74, 0.75, 0.76, 0.77, 0.78, 0.79 or 0.80 after maintaining the alloy in air continuously at a temperature of about 750° C. for 48 hours; no more than 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99, 1.00, 1.01, 1.02, 1.03, 1.04, 1.05, 1.06, 1.07, 1.08, 1.09, 1.10, 1.10, 1.11, 1.12, 1.13, 1.14, 1.15, 1.16, 1.17, 1.18, 1.19 or 1.20 after maintaining the alloy in air continuously at a temperature of about 750° C. for 96 hours; no more 0.95, 0.96, 0.97, 0.98, 0.99, 1.00, 1.01, 1.02, 1.03, 1.04, 1.05, 1.06, 1.07, 1.08, 1.09, 1.10, 1.10, 1.11, 1.12, 1.13, 1.14, 1.15, 1.16, 1.17, 1.18, 1.19, 1.20, 1.21, 1.22, 1.23, 1.24, 1.25, 1.26, 1.27, 1.28, 1.29, 1.30, 1.30, 1.31, 1.32, 1.33, 1.34, 1.35, 1.36, 1.37, 1.38, 1.39, 1.40, 1.41, 1.42, 1.43, 1.44, 1.45, 1.46, 1.47, 1.48, 1.49 or 1.50 after maintaining the alloy in air continuously at a temperature of about 750° C. for 160 hours; and no more 1.12, 1.13, 1.14, 1.15, 1.16, 1.17, 1.18, 1.19, 1.20, 1.21, 1.22, 1.23, 1.24, 1.25, 1.26, 1.27, 1.28, 1.29, 1.30, 1.30, 1.31, 1.32, 1.33, 1.34, 1.35, 1.36, 1.37, 1.38, 1.39, 1.40, 1.41, 1.42, 1.43, 1.44, 1.45, 1.46, 1.47, 1.48, 1.49, 1.50, 1.51, 1.52, 1.53, 1.54, 1.55, 1.56, 1.57, 1.58, 1.59, 1.60, 1.61, 1.62, 1.63, 1.64, 1.65, 1.66, 1.67, 1.68, 1.69, 1.70 or 2.00 after maintaining the alloy in air continuously at a temperature of about 750° C. for 208 hours.

Table 4 shows weight gain and alpha case depth of various alloys after specific oxidation testing. More particularly, present sample alloy Ti-6Al-6Sn-6Nb-0.5Mo-0.3Si (FIG. 4*d*) had an alpha case depth in microns or micrometers (μm) of no more than about 80, 85, 90, 95 or 100 after maintaining the alloy in air continuously at a temperature of about 750° C. for 208 hours; and no more than about 40, 45, 50 or 55 after maintaining the alloy in air continuously at a temperature of about 650° C. for 208 hours. In addition, present sample alloy Ti-6Al-6Sn-3Nb-0.5Mo-0.3Si (FIG. 4*e*) had an alpha case depth of no more than about 70, 75, 80, 85, 90, 95 or 100 after maintaining the alloy in air continuously at a temperature of about 750° C. for 208 hours; and no more than about 20, 25, 30, 35, 40, 45, 50 or 55 after maintaining the alloy in air continuously at a temperature of about 650° C. for 208 hours.

Tables 2 and 6 show tensile properties—ultimate tensile strength, yield strength and percent elongation—of various samples of titanium alloys. Table 2 provides a comparison of the tensile properties between samples of the present alloy and other titanium alloys at about 25, 200, 400, 600, 650, 700 and 750° C. (about 77, 392, 752, 1112, 1202, 1292 and 1382° F., respectively). In particular, the other titanium alloys in Table 2 are commercial alloys Ti-6Al-2Sn-4Zr-2Mo-0.1Si and Ti-15Mo-3Nb-3Al-0.3Si, while the present titanium alloys in Table 2 are Ti-6Al-4Sn-3Nb-0.5Mo-0.3Si and Ti-6Al-6Sn-3Nb-0.5Mo-0.3Si. Table 6 shows the tensile properties of the three above-noted microstructures of present sample alloy Ti-6Al-4Sn-3Nb-0.5Mo-0.3Si at the same temperatures in both the longitudinal direction (L-dir) and the transverse direction (T-dir).

The tested embodiments of the present titanium alloy had an ultimate tensile strength (UTS) measured in megapascals (MPa) of at least 1100, 1110, 1120, 1130, 1140, 1150, 1160, 1170, 1180, 1190, 1200, 1210, 1220 or 1230 at a temperature of about 25° C.; of at least 880, 890, 900, 910, 920, 930, 940, 950, 960, 970, 980, 990, 1000, 1010, 1020, 1030 or 1040 at a temperature of about 200° C.; of at least 760, 770, 780, 790, 800, 810, 820, 830, 840, 850, 860, 870, 880, 890, 900 or 910 at a temperature of about 400° C.; of at least 590, 600, 610, 620, 630, 640, 650, 660, 670, 680, 690, 700 or 710 at a temperature of about 600° C.; of at least 480, 490, 500, 510, 520, 530, 540, 550, 560, 570, 580, 590, 600, 610 or 620 at a temperature of about 650° C.; of at least 380, 390, 400, 410, 420, 430, 440, 450, 460, 470, 480, 490, 500, 510 or 520 at a temperature of about 700° C.; and of at least 260, 270, 280, 290, 300, 310, 320, 330, 340, 350, 360, 370, 380, 390, 390 or 400 at a temperature of about 750° C.

The tested embodiments of the present titanium alloy had a yield strength (YS) measured in MPa of at least 1000, 1010, 1020, 1030, 1040, 1050, 1060, 1070, 1080, 1090, 1100, 1110, 1120, 1130, 1140, 1150, 1160 or 1170 at a temperature of about 25° C.; of at least 750, 760, 770, 780, 790, 800, 810, 820, 830, 840, 850, 860, 870, 880, 890 or 900 at a temperature of about 200° C.; of at least 600, 610, 620, 630, 640, 650, 660, 670, 680, 690, 700, 710, 720, 730, 740, 750, 760, 770 or 780 at a temperature of about 400° C.; of at least 460, 470, 480, 490, 500, 510, 520, 530, 540 or 550 at a temperature of about 600° C.; of at least 370, 380, 390, 400, 410, 420, 430, 440, 450, 460, 470 or 480 at a temperature of about 650° C.; of at least 250, 260, 270, 280, 290, 300, 310, 320, 330, 340, 350 or 360 at a temperature of about 700° C.; and of at least 150, 160, 170, 180, 190, 200, 210, 220, 230, 240, 250, 260 or 270 at a temperature of about 750° C.

Tables 3 and 7 show the creep rupture property of various titanium alloys. Table 3 shows that the time to creep rupture at 650° C. and 138 MPa of the present sample titanium alloys Ti-6Al-4Sn-3Nb-0.5Mo-0.3Si and TI-6Al-6Sn-3Nb-0.5Mo-0.3Si is far greater than that of commercial alloys Ti-6Al-2Sn-4Zr-2Mo-0.1Si and Ti-15Mo-3Nb-3Al-0.3Si. Table 7 shows that for the present sample titanium alloy Ti-6Al-4Sn-3Nb-0.5Mo-0.3Si, in the longitudinal direction, the time to creep rupture for the above-noted bimodal I microstructure at 600° C. and 173 MPa is at least about 90, 95 or 100 hours; at 650° C. and 138 MPa is at least about 90, 95 or 100 hours; at 700° C. and 104 MPa is at least about 30, 35, 40 or 45 hours; and at 750° C. and 69 MPa is at least 10, 15, 20 or 25 hours. Table 7 also shows that for the present sample titanium alloy Ti-6Al-4Sn-3Nb-0.5Mo-0.3Si, in the longitudinal direction, the time to creep rupture for the above-noted bimodal II microstructure at 600° C. and 173 MPa is at least about 90, 95 or 100 hours; at 650° C. and 138 MPa is at least about 50, 55, 60, 65, 70 or 75 hours; at 700° C. and 104 MPa is at least about 5 or 10 hours; and at 750° C. and 69 MPa is at least 5, 10 or 15 hours. Table 7 further shows that for the present sample titanium alloy Ti-6Al-4Sn-3Nb-0.5Mo-0.3Si, in the longitudinal direction, the time to creep rupture for the above-noted equiaxed microstructure at 650° C. and 138 MPa is at least about 5, 10, 15 or 20 hours.

The alloy of the present invention may be heat treated to achieve targeted microstructures to optimize high strength and good creep rupture properties at elevated temperatures at least up to 750° C., and retain good ductility. When the solution treatment temperature is increased, the volume fraction of primary alpha is decreased, thereby leading to high strength and high creep resistance at elevated temperatures.

In certain applications, it may be important that the alloy of the present invention retains resistance to deformation at elevated temperatures for prolonged periods of use, and it may also be important that the alloy retains sufficient room temperature ductility after sustained thermal exposure. This is termed post-thermal-exposure stability. Table 8 demonstrates the room temperature (about 25° C.) tensile property of Ti-6Al-4Sn-3Nb-0.5Mo-0.3Si after thermal exposure at 650, 700, and 750° C. for 100 hours. The oxidation scale was removed before the samples were tensile tested. The present alloy shows excellent room temperature ductility and strength, indicating that the alloy has good post-thermal-exposure stability without deleterious and brittle phase precipitated.

The effect of oxidation scale on the room temperature (about 25° C.) tensile property is shown in Table 9. The tensile samples were tested with all the oxidation scale after thermal exposure at 650, 700, and 750° C. for 100 hours. Clearly, the alloy shows good room temperature strength and sufficient ductility or percent elongation of 2 to 4%. Particularly noteworthy is the room temperature tensile ductility or percent elongation of the present sample titanium alloy after thermal exposure at elevated temperatures as high as 750° C. for 100 hours. In contrast, the commercial Ti-6Al-2Sn-4Zr-2Mo-0.1Si and Ti-15Mo-3Nb-3Al-0.3Si alloys show severe oxidation scale flaking at the high temperature of 750° C. such that tensile ductility was not available or the materials were so brittle that the yield strength could not be obtained.

Referring generally to Table 8, the room temperature (about 25° C.) ultimate tensile strength (UTS) of Ti-6Al-4Sn-3Nb-0.5Mo-0.3Si having the above-noted bimodal I microstructure after continuous thermal exposure at about 650° C. for 100 hours with the oxidation scale removed is at least about 1100, 1110, 1120, 1130, 1140 or 1150 MPa; at about 700° C. for 100 hours with the oxidation scale removed is at least about 1100, 1110, 1120, 1130 or 1140 MPa; and at about 750° C. for 100 hours with the oxidation scale removed is at least about 1050, 1060, 1070, 1080 or 1090 MPa. The room temperature UTS of Ti-6Al-4Sn-3Nb-0.5Mo-0.3Si having the above-noted bimodal II microstructure after continuous thermal exposure at about 650° C. for 100 hours with the oxidation scale removed is at least about 1070, 1080, 1090, 1100, 1110 or 1120 MPa; at about 700° C. for 100 hours with the oxidation scale removed is at least about 1080, 1090, 1100, 1110 or 1120 MPa; and at about 750° C. for 100 hours with the oxidation scale removed is at least about 1050, 1060, 1070, 1080 or 1090 MPa. The room temperature UTS of Ti-6Al-4Sn-3Nb-0.5Mo-0.3Si having the above-noted equiaxed microstructure after continuous thermal exposure at about 650° C. for 100 hours with the oxidation scale removed is at least about 1170, 1180, 1190, 1200, 1210 or 1220 MPa; at about 700° C. for 100 hours with the oxidation scale removed is at least about 1100, 1110, 1120, 1130, 1140 or 1150 MPa; and at about 750° C. for 100 hours with the oxidation scale removed is at least about 1100, 1110, 1120, 1130, 1140, 1150, 1160 or 1170 MPa.

With continued general reference to Table 8, the room temperature yield strength (YS) of Ti-6Al-4Sn-3Nb-0.5Mo-0.3Si having the above-noted bimodal I microstructure after continuous thermal exposure at about 650° C. for 100 hours with the oxidation scale removed is at least about 1040, 1050, 1060, 1070 or 1080 MPa; at about 700° C. for 100 hours with the oxidation scale removed is at least about 1000, 1010, 1020, 1030, 1040, 1050, 1060 or 1070 MPa; and at about 750° C. for 100 hours with the oxidation scale removed is at least about 970, 980, 990, 1000 or 1010 MPa. The room temperature YS of Ti-6Al-4Sn-3Nb-0.5Mo-0.3Si having the above-noted bimodal II microstructure after continuous thermal exposure at about 650° C. for 100 hours with the oxidation scale removed is at least about 1040, 1050, 1060, 1070 or 1080 MPa; at about 700° C. for 100 hours with the oxidation scale removed is at least about 1000, 1010, 1020, 1030, 1040, 1050 or 1060 MPa; and at about 750° C. for 100 hours with the oxidation scale removed is at least about 980, 990, 1000, 1010 or 1020 MPa. The room temperature YS of Ti-6Al-4Sn-3Nb-0.5Mo-0.3Si having the above-noted equiaxed microstructure after continuous thermal exposure at about 650° C. for 100 hours with the oxidation scale removed is at least about 1130, 1140, 1150, 1160, 1170 or 1180 MPa; at about 700° C. for 100 hours with the oxidation scale removed is at least about 1040, 1050, 1060, 1070, 1080, 1090 or 1100 MPa; and at about 750° C. for 100 hours with the oxidation scale removed is at least about 1050, 1060, 1070, 1080, 1090, 1100 or 1110 MPa.

With continued general reference to Table 8, the room temperature percent elongation (El., %) of Ti-6Al-4Sn-3Nb-0.5Mo-0.3Si having the above-noted bimodal I microstructure after continuous thermal exposure at about 650° C. for 100 hours with the oxidation scale removed is at least about 10, 11, 12, 13 or 14; at about 700° C. for 100 hours with the oxidation scale removed is at least about 10, 11, 12, 13 or 14; and at about 750° C. for 100 hours with the oxidation scale removed is at least about 10, 11, 12, 13 or 14. The room temperature percent elongation of Ti-6Al-4Sn-3Nb-0.5Mo-0.3Si having the above-noted bimodal II microstructure after continuous thermal exposure at about 650° C. for 100 hours with the oxidation scale removed is at least about 10, 11, 12, 13, 14 or 15; at about 700° C. for 100 hours with the oxidation scale removed is at least about 10, 11, 12, 13 or 14; and at about 750° C. for 100 hours with the oxidation scale removed is at least about 10, 11, 12, 13, 14 or 15. The room temperature percent elongation of Ti-6Al-4Sn-3Nb-0.5Mo-0.3Si having the above-noted equiaxed microstructure after continuous thermal exposure at about 650° C. for 100 hours with the oxidation scale removed is at least about 7, 8, 9, 10 or 11; at about 700° C. for 100 hours with the oxidation scale removed is at least about 7, 8, 9, 10 or 11; and at about 750° C. for 100 hours with the oxidation scale removed is at least about 7, 8, 9, 10, 11 or 12.

Referring generally to Table 9, the room temperature (about 25° C.) ultimate tensile strength (UTS) of Ti-6Al-4Sn-3Nb-0.5Mo-0.3Si having the above-noted bimodal I microstructure after continuous thermal exposure at about 650° C. for 100 hours with the oxidation scale remaining on the test sample is at least about 1090, 1100, 1110, 1120, 1130 or 1140 MPa; at about 700° C. for 100 hours with the oxidation scale remaining on the test sample is at least about 1080, 1090, 1100, 1110 or 1120 MPa; and at about 750° C. for 100 hours with the oxidation scale remaining on the test sample is at least about 1020, 1030, 1040, 1050 or 1060 MPa. The room temperature UTS of Ti-6Al-4Sn-3Nb-0.5Mo-0.3Si having the above-noted bimodal II microstructure after continuous thermal exposure at about 650° C. for 100 hours with the oxidation scale remaining on the test sample is at least about 1070, 1080, 1090, 1100, 1110, 1120 or 1130 MPa; at about 700° C. for 100 hours with the oxidation scale remaining on the test sample is at least about 1040, 1050, 1060, 1070 or 1080 MPa; and at about 750° C. for 100 hours with the oxidation scale remaining on the test sample is at least about 1000, 1010, 1020, 1030, 1040 or 1050 MPa.

With continued general reference to Table 9, the room temperature yield strength (YS) of Ti-6Al-4Sn-3Nb-0.5Mo-0.3Si having the above-noted bimodal I microstructure after continuous thermal exposure at about 650° C. for 100 hours with the oxidation scale remaining on the test sample is at least about 1040, 1050, 1060, 1070, 1080, 1090 or 1100 MPa; at about 700° C. for 100 hours with the oxidation scale remaining on the test sample is at least about 1000, 1010, 1020, 1030, 1040, 1050, 1060 or 1070 MPa; and at about 750° C. for 100 hours with the oxidation scale remaining on the test sample is at least about 970, 980, 990, 1000 or 1010 MPa. The room temperature YS of Ti-6Al-4Sn-3Nb-0.5Mo-0.3Si having the above-noted bimodal II microstructure after continuous thermal exposure at about 650° C. for 100 hours with the oxidation scale remaining on the test sample is at least about 1040, 1050, 1060, 1070, 1080 or 1090 MPa; at about 700° C. for 100 hours with the oxidation scale remaining on the test sample is at least about 990, 1000, 1010, 1020 or 1030 MPa; and at about 750° C. for 100 hours with the oxidation scale remaining on the test sample is at least about 970, 980, 990, 1000 or 1010 MPa.

With continued general reference to Table 9, the room temperature percent elongation (El., %) of Ti-6Al-4Sn-3Nb-0.5Mo-0.3Si having the above-noted bimodal I microstructure after continuous thermal exposure at about 650° C. for 100 hours with the oxidation scale remaining on the test sample is at least about 1, 2 or 3; at about 700° C. for 100 hours with the oxidation scale remaining on the test sample is at least about 1, 2 or 3; and at about 750° C. for 100 hours with the oxidation scale remaining on the test sample is at least about 1, 2 or 3. The room temperature percent elongation of Ti-6Al-4Sn-3Nb-0.5Mo-0.3Si having the above-noted bimodal II microstructure after continuous thermal exposure at about 650° C. for 100 hours with the oxidation scale remaining on the test sample is at least about 1, 2 or 3; at about 700° C. for 100 hours with the oxidation scale remaining on the test sample is at least 1, 2, 3 or 4; and at about 750° C. for 100 hours with the oxidation scale remaining on the test sample is at least about 1, 2 or 3.

The present alloy is highly formable at room temperature (cold forming ability) or at elevated temperatures (hot forming ability). Table 10 shows the double bend test data of Ti-6Al-4Sn-3Nb-0.5Mo-0.3Si. As a near-alpha alloy, the present alloy can be cold formed with a radius/thickness ratio of 2.6, 2.7, 2.8, 2.9, 3.0, 3.1, 3.2, 3.3, 3.4, 3.5, 3.6, 3.7, 3.8, 3.9 or 4.0, clearly lower than the required radius/thickness ratio 4.5 of Ti-6Al-2Sn-4Zr-2Mo-0.1Si. Table 11 shows the rapid strain rate tensile results of Ti-6Al-4Sn-3Nb-0.5Mo-0.3Si at elevated temperatures of about 780 to about 930° C. The present alloy shows a good hot forming ability, with very high ductility or percent elongation (about 90 to 230% elongation) and sufficient low flow stress at elevated temperatures.

The alloy of the present invention can also be formed into complex shaped parts using the superplastic forming (SPF) technique. Table 12 shows the superplastic forming property of Ti-6Al-4Sn-3Nb-0.5Mo-0.3Si at a strain rate of $3\times10^{-4}$/second at a temperature range of 925 to 970° C. The present alloy shows 340 to 460% elongation and sufficient low flow stress for SPF forming. The testing also demonstrates that the present alloy is a weldable titanium alloy, as it is a near-alpha titanium alloy.

As may be seen from the data presented above, the present invention provides a high temperature oxidation resistant titanium alloy which can be used at elevated temperatures at least up to 750° C. The present alloy has not only higher strength at elevated temperatures but also much greater oxidation resistance than commercial alloys, such as Ti-6Al-2Sn-4Zr-2Mo-0.1Si and Ti-15Mo-3Nb-3Al-0.3Si, and it exhibits a good combination of excellent oxidation resistance, high strength and creep resistance at elevated temperatures, and good post-thermal-exposure stability. Moreover, this alloy may be manufactured into parts using the cold forming, hot forming, superplastic forming, and welding technique.

These properties and performance of the present alloy are achieved by a strict control of alloy chemistry. In particular, the combined additions of niobium and tin should be kept within a given range. Aluminum, molybdenum, silicon, and oxygen should also be controlled within a given range to get a good combination of the properties. Impurities such as zirconium, iron, nickel, and chromium should be kept at a considerably low level.

TABLE 1

Oxidation testing results of various titanium alloys

| Alloy | Test Temp ° C. | Weight Gain, mg/cm$^2$ 0 hrs | 24 hrs | 48 hrs | 72 hrs | 96 hrs | 160 hrs | 208 hrs |
|---|---|---|---|---|---|---|---|---|
| Ti—6Al—2Sn—4Zr—2Mo—0.1Si | 650 | 0 | 0.15 | 0.21 | 0.26 | 0.28 | 0.38 | 0.43 |
| | 700 | 0 | 0.32 | 0.44 | 0.52 | 0.61 | 0.86 | 1.08 |
| | 750 | 0 | 0.70 | 1.21 | 1.64 | 2.20 | 3.93 | 7.22 |
| Ti—15Mo—3Nb—3Al—0.3Si | 650 | 0 | 0.28 | 0.38 | 0.43 | 0.48 | 0.57 | 0.61 |
| | 700 | 0 | 0.44 | 0.70 | 1.03 | 1.39 | 2.16 | 2.66 |
| | 750 | 0 | 0.99 | 1.88 | 3.55 | 5.85 | 12.7 | 19.1 |
| Ti—6Al—4Sn—3Nb—0.5Mo—0.3Si | 650 | 0 | 0.08 | 0.12 | 0.15 | 0.14 | 0.19 | 0.20 |
| | 700 | 0 | 0.17 | 0.23 | 0.28 | 0.32 | 0.42 | 0.47 |
| | 750 | 0 | 0.36 | 0.50 | 0.64 | 0.74 | 1.00 | 1.17 |
| Ti—6Al—6Sn—3Nb—0.5Mo—0.3Si | 650 | 0 | 0.09 | 0.12 | 0.13 | 0.15 | 0.20 | 0.22 |
| | 700 | 0 | 0.19 | 0.26 | 0.31 | 0.34 | 0.45 | 0.51 |
| | 750 | 0 | 0.38 | 0.53 | 0.66 | 0.79 | 1.06 | 1.25 |

TABLE 2

Mechanical property testing results of various titanium alloys

| Alloy | Tensile Property | Testing Temperature, ° C. 25 | 200 | 400 | 600 | 650 | 700 | 750 |
|---|---|---|---|---|---|---|---|---|
| Ti—6Al—2Sn—4Zr—2Mo—0.1Si | UTS, MPa | 1032 | 856 | 776 | 571 | 475 | 389 | 242 |
| | YS, MPa | 949 | 723 | 622 | 439 | 351 | 205 | 131 |
| | EL, % | 13 | 14 | 17 | 32 | 72 | 46 | 119 |
| Ti—15Mo—3Nb—3Al—0.3Si | UTS, MPa | 934 | 743 | 680 | 423 | 300 | 197 | 119 |
| | YS, MPa | 871 | 641 | 552 | 328 | 213 | 126 | 63 |
| | EL, % | 18 | 22 | 26 | 50 | 120 | 200 | 200 |
| Ti—6Al—4Sn—3Nb—0.5Mo—0.3Si | UTS, MPa | 1152 | 918 | 765 | 601 | 487 | 402 | 314 |
| | YS, MPa | 1093 | 788 | 758 | 481 | 380 | 314 | 216 |
| | EL, % | 17 | 18 | 20 | 36 | 46 | 46 | 73 |
| Ti—6Al—6Sn—3Nb—0.5Mo—0.3Si | UTS, MPa | 1143 | 934 | 852 | 600 | 544 | 410 | 317 |
| | YS, MPa | 1079 | 824 | 711 | 491 | 406 | 293 | 188 |
| | EL, % | 15 | 16 | 15 | 35 | 36 | 49 | 90 |

TABLE 3

Creep rupture property testing of various titanium alloys

| Alloy | Creep rupture property at 650° C. and 138 MPa Time to creep rupture, hrs |
|---|---|
| Ti—6Al—2Sn—4Zr—2Mo—0.1Si | 25.5 |
| Ti—15Mo—3Nb—3Al—0.3Si | 3.4 |

TABLE 3-continued

Creep rupture property testing of various titanium alloys

| Alloy | Creep rupture property at 650° C. and 138 MPa Time to creep rupture, hrs |
|---|---|
| Ti—6Al—4Sn—3Nb—0.5Mo—0.3Si | 71.9 |
| Ti—6Al—6Sn—3Nb—0.5Mo—0.3Si | 44.0 |

TABLE 4

Weight gain and alpha case depth of various titanium alloys

| Alloy | 750° C./208 hrs Oxidation Testing Weight Gain, mg/cm2 | alpha-case, μm | 650° C./208 hrs Oxidation Testing Weight Gain, mg/cm2 | alpha-case, μm |
|---|---|---|---|---|
| Ti—6Al—2Sn—4Zr—2Mo—0.1Si | 7.22 | 141 | 0.43 | 64 |
| Ti—6Al—6Zr—6Nb—0.5Mo—0.3Si | 1.97 | 143 | 0.34 | 96 |
| Ti—6Al—2Sn—4Zr—6Nb—0.5Mo—0.3Si | 1.88 | 145 | 0.33 | 70 |
| Ti—6Al—6Sn—6Nb—0.5Mo—0.3Si | 1.27 | 82 | 0.24 | 45 |
| Ti—6Al—6Sn—3Nb—0.5Mo—0.3Si | 1.25 | 75 | 0.22 | 24 |

TABLE 5

Oxidation testing results of Ti—6Al—4Sn—3Nb—0.5Mo—0.3Si alloy

| Micro-structure | Test Temp ° C. | Weight Gain, mg/cm2 0 hrs | 24 Hrs | 48 hrs | 72 hrs | 96 hrs | 160 hrs | 208 hrs |
|---|---|---|---|---|---|---|---|---|
| Bimodal I | 650 | 0 | 0.09 | 0.12 | 0.14 | 0.15 | 0.20 | 0.21 |
| | 700 | 0 | 0.18 | 0.25 | 0.29 | 0.34 | 0.43 | 0.48 |
| | 750 | 0 | 0.35 | 0.49 | 0.61 | 0.72 | 0.95 | 1.12 |
| Bimodal II | 650 | 0 | 0.08 | 0.12 | 0.15 | 0.14 | 0.19 | 0.20 |
| | 700 | 0 | 0.17 | 0.23 | 0.28 | 0.32 | 0.42 | 0.47 |
| | 750 | 0 | 0.36 | 0.50 | 0.64 | 0.74 | 1.00 | 1.17 |
| Equiaxed | 650 | 0 | 0.08 | 0.11 | 0.13 | 0.14 | 0.18 | 0.21 |
| | 700 | 0 | 0.17 | 0.24 | 0.28 | 0.33 | 0.43 | 0.49 |
| | 750 | 0 | 0.41 | 0.60 | 0.73 | 0.88 | 1.14 | 1.33 |

TABLE 6

Mechanical property testing results of Ti—6Al—4Sn—3Nb—0.5Mo—0.3Si alloy

| Micro-structure | Tensile Property | Testing Temperature, ° C. 25 | 200 | 400 | 600 | 650 | 700 | 750 |
|---|---|---|---|---|---|---|---|---|
| Bimodal I L-dir | UTS, MPa | 1157 | 914 | 801 | 636 | 522 | 420 | 335 |
| | YS, MPa | 1090 | 894 | 633 | 487 | 391 | 302 | 219 |
| | El., % | 16 | 18 | 19 | 29 | 40 | 43 | 94 |
| Bimodal I T-dir | UTS, MPa | 1204 | 1030 | 898 | 698 | 609 | 517 | 387 |
| | YS, MPa | 1092 | 867 | 735 | 542 | 476 | 359 | 262 |
| | El., % | 15 | 18 | 18 | 19 | 26 | 28 | 53 |
| Bimodal II L-dir | UTS, MPa | 1152 | 918 | 765 | 601 | 487 | 402 | 314 |
| | YS, MPa | 1093 | 788 | 758 | 481 | 380 | 314 | 216 |
| | El., % | 17 | 18 | 20 | 36 | 46 | 46 | 73 |
| Bimodal II T-dir | UTS, MPa | 1183 | 1019 | 880 | 694 | 604 | 473 | 352 |
| | YS, MPa | 1090 | 873 | 740 | 515 | 424 | 334 | 240 |
| | El., % | 9 | 14 | 16 | 19 | 11 | 13 | 36 |
| Equiaxed L-dir | UTS, MPa | 1221 | 990 | 893 | 638 | 517 | 388 | 264 |
| | YS, MPa | 1165 | 890 | 777 | 515 | 376 | 270 | 153 |
| | El., % | 14 | 14 | 13 | 28 | 55 | 93 | 179 |

TABLE 7

Creep rupture property of Ti—6Al—4Sn—3Nb—0.5Mo—0.3Si alloy

| Microstructure | Sample Direction | Creep Rupture Testing Condition | Rupture Time, hrs | Creep Deforma-tion, % |
|---|---|---|---|---|
| Bimodal I | L-dir | 600° C./173 MPa | 100* | 4.1 |
| | L-dir | 650° C./138 MPa | 100* | 23.8 |
| | L-dir | 700° C./104 MPa | 42.8 | 66.4 |
| | L-dir | 750° C./69 MPa | 23.1 | 42.7 |
| Bimodal II | L-dir | 600° C./173 MPa | 100* | 6.1 |
| | L-dir | 650° C./138 MPa | 71.9 | 40.9 |
| | L-dir | 700° C./104 MPa | 9.8 | 6.6 |
| | L-dir | 750° C./69 MPa | 13.9 | 49.0 |
| Equiaxed | L-dir | 650° C./138 MPa | 16.6 | 52.1 |

Note:
100* indicates that the rupture time is more than 100 hours

TABLE 8

Room Temperature Tensile Property of Ti—6Al—4Sn—3Nb—0.5Mo—0.3Si alloy after Thermal Exposure (Oxidation Scale Removed)

| Thermal Exposure | Microstructure | Tensile Property UTS, MPa | YS, MPa | El., % |
|---|---|---|---|---|
| 650° C./100 hrs | Bimodal I | 1152 | 1083 | 14 |
| | Bimodal II | 1120 | 1073 | 15 |
| | Equiaxed | 1220 | 1177 | 11 |
| 700° C./100 hrs | Bimodal I | 1141 | 1065 | 14 |
| | Bimodal II | 1124 | 1052 | 14 |
| | Equiaxed | 1153 | 1092 | 11 |
| 750° C/100 hrs | Bimodal I | 1090 | 1008 | 14 |
| | Bimodal II | 1092 | 1012 | 15 |
| | Equiaxed | 1170 | 1099 | 12 |

TABLE 9

Room Temperature Tensile Property of Ti—6Al—4Sn—3Nb—0.5Mo—0.3Si alloy after Thermal Exposure (With Oxidation Scale)

| Thermal Exposure | Microstructure | Tensile Property UTS, MPa | YS, MPa | El., % |
|---|---|---|---|---|
| 650° C./100 hrs | Bimodal I | 1136 | 1100 | 3 |
| | Bimodal II | 1124 | 1086 | 3 |
| 700° C./100 hrs | Bimodal I | 1112 | 1070 | 3 |
| | Bimodal II | 1074 | 1030 | 4 |
| 750° C./100 hrs | Bimodal I | 1052 | 1012 | 2 |
| | Bimodal II | 1047 | 1008 | 3 |

TABLE 10

Double Bend Ductility of Ti—6Al—4Sn—3Nb—0.5Mo—0.3Si alloy

| Bend radius/sheet thickness (R/t) | Double Bend Result First bend | Second bend |
|---|---|---|
| 2.88 | pass | pass |
| 2.61 | pass | fail |

Ti-6242 sheet specification requires to pass R/t = 4.5

TABLE 11

Hot Forming Property of Ti—6Al—4Sn—3Nb—0.5Mo—0.3Si alloy (Rapid Strain Rate Tensile Property, 0.01/sec)

| Temp. ° C. | 788 | 816 | 843 | 871 | 927 |
|---|---|---|---|---|---|
| True Stress at 0.2 true strain, MPa | 348 | 293 | 236 | 187 | 110 |
| Elongation, % | 91 | 95 | 190 | 200 | 230 |

TABLE 12

Superplastic Forming Property of Ti—6Al—4Sn—3Nb—0.5Mo—0.3Si alloy (Strain rate, $3 \times 10^{-4}$/second)

| SPF Temp., ° C. | 927 | 940 | 954 | 968 |
|---|---|---|---|---|
| Stress at 0.2 true train, MPa | 30 | 25 | 20 | 17 |
| Stress at 1.1 true train, MPa | 37 | 33 | 26 | 25 |
| Total Elongation, % | 400 | 460 | 360 | 340 |

The room temperature (about 25° C.) tensile testing shown in Tables 2, 6, 8 and 9 was performed in accordance with ASTM E8-11 (Standard Test Methods for Tension Testing of Metallic Materials); the elevated temperature tensile testing shown in Tables 2, 6, 8 and 9 was performed in accordance with ASTM E21-09 (Standard Test Methods for Elevated Temperature Tension Tests of Metallic Materials); the hot forming property testing shown in Table 11 was performed in accordance with ASTM E21-09; the creep rupture testing shown in Tables 3 and 7 was performed in accordance with ASTM 139-11 (Standard Test Methods for Conducting Creep, Creep-Rupture, and Stress-Rupture Tests of Metallic Materials); the double bend testing shown in Table 10 was performed in accordance with ASTM E290-09 (Standard Test Methods for Bend Testing of Material for Ductility); the superplastic forming testing shown in Table 12 was performed in accordance with ASTM E2448-08 (Standard Test Method for Determining the Superplastic Properties of Metallic Sheet Materials); samples used in the oxidation testing concerning weight gain and alpha case depth (Tables 1, 4 and 5) were about 2 mm×10 mm×50 mm.

Generally, the present titanium alloys have excellent oxidation resistance, high strength and creep resistance at elevated temperatures of at least 600, 650, 700 and 750° C., as well as good cold/hot forming ability, good superplastic forming performance, and good weldability. These titanium alloys have can be used for structural parts, to which oxidation resistance, corrosion resistance, high strength at elevated temperatures and light weight are required, for example, airframe parts (heat shield, plug nozzle etc.), aero-engine parts (casing, blades and vanes) and automobile parts (valves).

The present alloys may be used to form a variety of components, articles or parts, especially those needing high strength at elevated temperatures. Although the present alloys are very useful at higher temperatures such as 650, 700 or 750° C., the present alloys may also provide significant advantages at the somewhat lower temperature of 600° C. (1112° F.) or lower temperatures. That is, although other titanium alloys may be well suited for use at such lower elevated temperatures, the present titanium alloys provide significant advantages at these temperatures due at least in part to the characteristics discussed previously.

Figure 5:
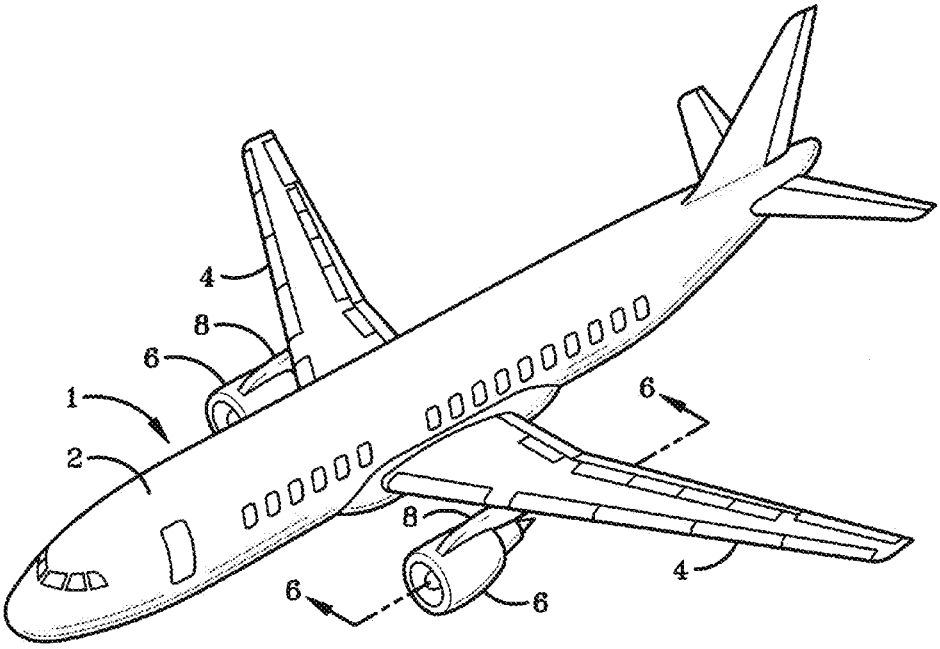
FIG. 5 is a perspective view of an aircraft showing engines mounted on the aircraft wings.
Figure 6:
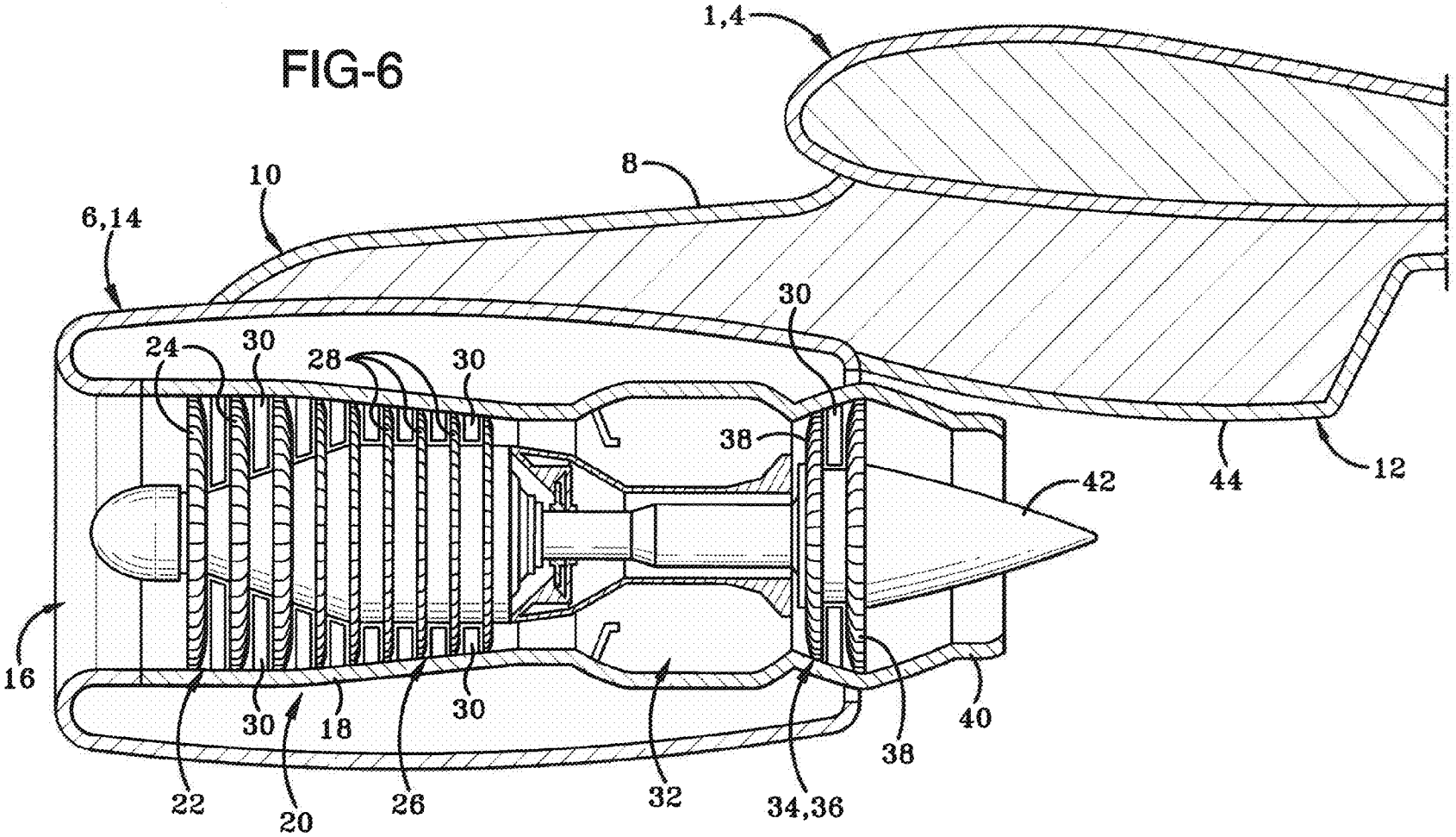
FIG. 6 is an enlarged sectional view taken on line 6-6 of FIG. 5 showing various components of the aircraft engine, pylon and wing.

FIGS. 5-8 illustrate some of the components which may be formed of the present titanium alloys. Referring to FIG. 5, an aircraft 1 is shown having a fuselage 2, wings 4 and gas turbine engines 6 mounted on aircraft wings 4 via respective pylons 8. FIG. 6 shows that pylon 8 is secured to wing 4 and extends downwardly and forward therefrom with aircraft engine 6 secured to and extending downwardly from pylon 8. More particularly, pylon 8 has a forward section 10 and a rear or aft section 12 such that the top of rear 12 is secured to the bottom of wing 4 and the bottom of front section 10 is secured to the top of engine 6. Generally, many engine components of engine 6 or pylon components of pylon 8 may be formed of the present alloy, including but not limited to those detailed below.

Engine 6 may include a nacelle 14 with a front end defining an air intake 16, an engine casing 18, a compressor section 20 which may include a low pressure compressor 22 with low pressure rotary compressor blades 24 and a high pressure compressor 26 with high pressure rotary compressor blades 28, static or stator airfoils or vanes 30, a combustion chamber 32, a turbine section 34 which may include a turbine 36 with rotary turbine blades 38, an exhaust system including an exhaust nozzle or nozzle assembly 40 and an exhaust plug 42, and various fasteners, such as high temperature fasteners. Vanes 30 may be in compressor section 20 and/or turbine section 34. Aft pylon 8 includes various aft pylon components including a heat shield 44 along the bottom of pylon 8 and various fasteners. One heat shield representative of the type of heat shield shown at 44 is disclosed in U.S. Pat. No. 7,943,227, which is incorporated herein by reference. Another such heat shield, also referred to as an aft pylon fairing, is disclosed in US Patent Application Publication 2011/0155847, which is also incorporated herein by reference.

Figure 7:
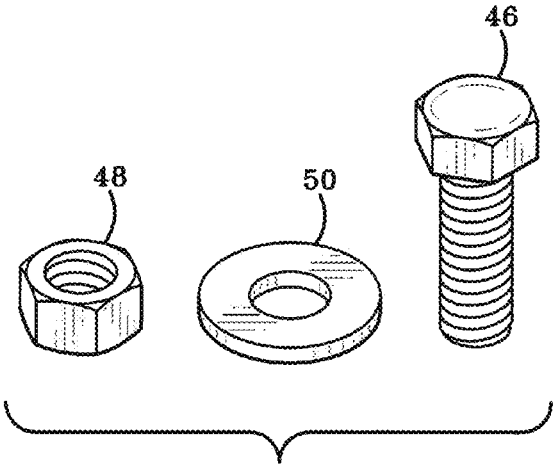
FIG. 7 is a perspective view showing various fasteners or fastener components.

The fasteners or fastener components of engine 6 and/or pylon 8 may be represented by the fasteners and/or fastener components illustrated in FIG. 7, which shows in particular a threaded fastener in the form of a bolt 46, a threaded nut 48 and a washer 50. The fasteners or fastener components shown in FIG. 7 are simplified and generic and are intended to represent a host of other types of fasteners and fastener components which are well known. Such fasteners or components may, for instance, be used in aircraft engines or more generally in an aircraft. Such fasteners or components may also be used in various high temperature environments, for example other types of engines such as internal combustion engines used in automobiles or other vehicles or for other purposes. The fasteners or components formed of the present titanium alloys may be used in lower temperature environments, but are especially useful to provide high strength fasteners in high temperature environments, such as the temperatures discussed previously.

As is well known, aircraft engine 6 is one form of a fuel powered engine which creates a substantial amount of heat during operation. While engine 6 is illustrated as an aircraft gas turbine engine, it may also represent other types of fuel powered engines such as any internal combustion engine which may be a reciprocating engine, for instance an automobile engine. Thus, the present titanium alloys may be used to form components of such fuel powered engines and are especially useful for the relatively high temperature parts or components which are thus more susceptible to oxidation.

Figure 8:
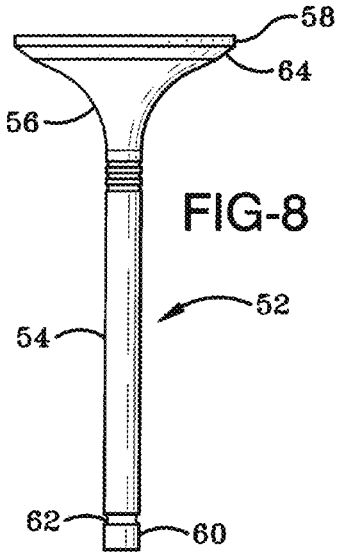
FIG. 8 is an elevation view of an automobile engine valve.

FIG. 8 shows one such component in the form of an automobile engine valve 52 which includes a stem 54, a fillet 56 and a valve head 58. Fillet 56 tapers concavely inwardly from valve head 58 to stem 54. Stem 54 terminates at a tip 60 opposite head 58. Stem 54 adjacent tip 60 defines a keeper groove 62 for receiving a retainer for a valve spring of the engine. Head 58 has a valve seat face 64 configured to seat against a valve seat of the engine. An engine poppet valve such as valve 58 is disclosed in U.S. Pat. No. 6,718,932, which is incorporated herein by reference.

Engine 6, which may as noted above, for example represent a gas turbine engine or a reciprocating engine or any fuel powered engine, may also more broadly represent a machine which may include a component made of one of the present alloys so that operating the machine will produce heat such that the component is continuously maintained at an operational temperature of at least 600, 650, 700 or 750° C. for a duration of at least ½ hour, an hour, two hours, three hours, four hours, five hours, six hours, seven hours, eight hours, nine hours, ten hours or more, such as the durations noted in the relevant Tables provided herein with respect to maintaining the temperature at 24 hours, 48 hours and so forth. The machine may also be operated such that the component reaches these temperatures for the times or durations noted, not necessarily in a continuous manner, but rather in an intermittent manner, and thus the total duration of the intermittent time periods or durations, for instance, may equal, for example, any of the above-noted specific durations. In either case, the component will generally be exposed to such temperatures in air whereby the total duration of exposure to oxidation at such elevated temperatures is similar whether continuous or intermittent.

Applicant reserves the right to claim the present alloys, parts formed thereof or related methods in any increments of values noted herein, including for example, but not limited to, to the percentages of the elements making up the present alloys, temperatures and hours recited, amount of weight gain, depth of alpha case, degree of elongation, and so forth.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A high temperature titanium alloy comprising:
5.0 to 7.0% aluminum by weight;
3.0 to 6.0% tin by weight;
2.5 to 6.0% niobium by weight;
0.1 to 1.5% molybdenum by weight;
0.1 to 0.6% silicon by weight
zirconium below 0.1% by weight;
no more than 0.20% oxygen;
no more than 0.10% carbon;
iron, nickel, chromium, copper and manganese are each below 0.1% by weight and a total of <0.3 combined;
hafnium and rhenium in a range of 0.0 to 0.3% by weight and <0.3 combined and
a balance titanium.

2. The alloy of claim 1 wherein aluminum is 5.5 to 6.5% by weight; tin is 3.5 to 4.5% by weight; niobium is 3.0 to 3.25% by weight; molybdenum is 0.5 to 0.8% by weight; silicon is 0.30 to 0.45% by weight; oxygen is 0.08 to 0.12% by weight; carbon is 0.02 to 0.04% by weight.

3. The alloy of claim 1 wherein the alloy comprises a total of zirconium and vanadium in a range of 0.0 to 0.5% by weight.

4. The alloy of claim 1 wherein the alloy has an ultimate tensile strength of at least 260 at a temperature of about 750° C.

5. The alloy of claim 1 wherein the alloy has a yield strength of at least 150 at a temperature of about 750° C.

6. The alloy of claim 1 wherein the alloy has a weight gain of no more than 2.00 mg/cm$^2$ after maintaining the alloy in air continuously at a temperature of about 750° C. for a duration of 208 hours.

7. The alloy of claim 1 wherein the alloy has an alpha case depth of no more than about 100 microns after maintaining the alloy in air continuously at a temperature of about 750° C. for 208 hours.

8. The alloy of claim 1 wherein the alloy at a temperature of about 25° C. has a percent elongation of at least 2% after exposure in air to a temperature of 750° C. for 100 hours.

9. The alloy of claim 1 wherein the alloy comprises no more than 0.1 weight percent of vanadium.

10. The alloy of claim 1, further comprising tantalum within the range of 0.0 to 1.0% by weight and wherein tin is 4.0-6.0% by weight.

11. The alloy of claim 1 wherein aluminum is 5.5 to 6.5% by weight; tin is 3.5 to 4.5% by weight; niobium is 4-6% by weight; molybdenum is 0.5 to 0.8% by weight; silicon is 0.30 to 0.45% by weight; oxygen is 0.08 to 0.12% by weight; and carbon is 0.03 to 0.04% by weight.

12. An aircraft engine component formed from the alloy of claim 1.

13. The aircraft engine component of claim 12 wherein the aircraft engine component comprises at least a portion of one of an aircraft engine nacelle, an aircraft engine casing, an aircraft engine rotary compressor blade, an aircraft engine stator vane, an aircraft engine rotary turbine blade, an aircraft engine exhaust nozzle, an aircraft engine exhaust plug and an aircraft engine fastener.

14. A portion of a heat shield of an aircraft engine pylon formed from the alloy of claim 1.

15. An internal combustion engine component formed from the alloy of claim 1.

16. The internal combustion engine component of claim 15 wherein the internal combustion engine component is a valve.

17. A component of a gas turbine engine formed from the alloy of claim 1.

18. A component having an operational temperature of at least about 600° C. formed from the alloy of claim 1.

19. A high temperature titanium alloy comprising:
5.0 to 7.0% aluminum by weight;
3.0 to 6.0% tin by weight;
2.5 to 6.0% niobium by weight;
0.1 to 1.5% molybdenum by weight;
0.1 to 0.6% silicon by weight;
zirconium below 0.1% by weight;
a total of zirconium and vanadium in a range of 0.0 to 0.5% by weight;
a total of hafnium and rhenium in a range of 0.0 to 0.3% by weight; and a balance titanium.

20. The alloy of claim 19 wherein the alloy comprises no more than 0.1 weight percent of vanadium.

21. The alloy of claim 19 wherein the alloy comprises
no more than 0.20 weight percent of oxygen;
no more than 0.10 weight percent of carbon;
no more than 0.10 weight percent of each of nickel, iron, chromium, copper and manganese.

22. The alloy of claim 19 wherein
aluminum is 5.5 to 6.5% by weight;
tin is 3.5 to 4.5% by weight;
niobium is 2.75 to 3.25% by weight;
molybdenum is 0.5 to 0.8% by weight;
silicon is 0.30 to 0.45% by weight;
oxygen is 0.08 to 0.12% by weight;
carbon is 0.02 to 0.04% by weight;
each of nickel, iron, chromium, copper and manganese is no more than 0.10% by weight.

23. The alloy of claim 19, further comprising tantalum within the range of 0.0 to 1.0% by weight.

* * * * *